United States Patent [19]

Gregory

[11] Patent Number: 4,919,298

[45] Date of Patent: Apr. 24, 1990

[54] TRIM BUCKET

[76] Inventor: Steven R. Gregory, 1459 Palisades Dr., Pacific Palisades, Calif. 90272

[21] Appl. No.: 221,130

[22] Filed: Jul. 19, 1988

Related U.S. Application Data

[63] Continuation-in-part of Ser. No. 67,209, Jun. 29, 1987, abandoned.

[51] Int. Cl.[5] ..... B65D 25/28

[52] U.S. Cl. ..... 220/94 R; 220/90

[58] Field of Search ..... 220/94 R, 94 A, 96, 220/90

[56] References Cited

U.S. PATENT DOCUMENTS

| | | | |
|---|---|---|---|
| 2,536,215 | 1/1951 | Povondra | 220/90 X |
| 2,542,737 | 2/1951 | Vogel | 220/90 |
| 2,560,220 | 7/1951 | Kosorok | 220/90 |
| 3,981,044 | 9/1976 | Luebke et al. | 220/94 R X |
| 4,023,702 | 5/1977 | McKnight | 220/94 R |

*Primary Examiner*—Steven M. Pollard

*Attorney, Agent, or Firm*—Edwin T. Bean Jr.; Martin G. Linihan; John C. Thompson

[57] ABSTRACT

A paint bucket comprised of a container, a relatively rigid handle and a brush rest. The container includes a bottom and side portion, the side portion defining an open top. The handle includes a connecting section and a gripping section. The connecting section is connected to the side of the container so as to be affixed thereto in a relatively rigid fashion, and so that the gripping section of the handle is disposed directly above the container. The brush rest is integrally formed with the gripping section and includes means for nestingly accepting the handle of the paint brush so as to maintain the handle in an upright position. An alternative embodiment includes adjustment means associated with the container and adapted to receive the handle connecting section therebetween to facilitate adjustment of the handle in an orientation parallel to the axis; and means for pivotally connecting the handle gripping section and the handle connecting section together to facilitate stowing the handle within the container when in a removed condition relative to the container for shipping and storage.

6 Claims, 2 Drawing Sheets

TRIM BUCKET

This application is a continuation in part of Ser. No. 07/067,209 filed on 06/29/87, now abandoned.

BACKGROUND OF THE INVENTION

This invention relates generally to an apparatus for painting and relates more particularly to a paint bucket which is particularly well-suited for use as a trim bucket.

For the painting of surfaces, such as those of room corners, door jambs, molding or similar trim, which normally cannot be satisfactorily painted with a conventional paint roller, a conventional paint brush having bristles at one end and a handle at the other end typically is utilized. Commonly, the conventional point brush is used to transfer paint to and spreading paint across the surface to be painted by sequentially dipping the bristle end of the brush into a quantity of paint and then sliding the bristle end across the surface with a stroking motion.

During the course of painting such a surface, the paint can in which the quantity of paint is purchased is commonly used as the container into which the paint brush is repetitively dipped. Such cans typically include a container and a arcuate wirelike handle or bail having two opposite ends, each of which is pivotally connected to a corresponding side of the container. The pivotal connection between the handle and container permits the handle to be pivoted between an operative condition at which the handle spans the top of the container and enables the can to be carried by the handle and an inoperative condition at which the handle rests against the sides of the container and below the top thereof.

The handle of the afore described paint can is believed to be responsible for difficulties involved when using the can as a paint container during painting. If, for example, the handle is positioned in the inoperative condition against the side of the container opposite the painter, the handle may be difficult for the painter to grasp. Furthermore, the pivotal connection between the handle and container permits the container to freely swing relative to the handle as the can is being carried by the handle. Of course, the permitted swing of the container increases the likelihood of paint spillage.

Accordingly, it is the primary object of the present invention to provide a new and improved paint bucket having a handle which can be easily grasped for purposes of carrying the bucket and a container which is not permitted to swing relative to the handle.

A further object of the present invention is to provide adjustment means facilitating the movement of said handle in an orientation parallel to the axis of the container.

A further object of the present invention is to provide such a paint bucket having means upon which a conventional paint brush can be conveniently rested when the brush is not in use.

A further object of the present invention is to provide such a paint brush rest which is adjustable thereby facilitating the use of various length brushes.

A further object of the present invention is to provide such a paint bucket wherein the means upon which the brush can be rested facilitates the transporting of the bucket and brush with one hand while the brush is oriented in an upright position within the bucket container.

A further object of the present invention is to provide a handle which is removably affixed to the container.

A further object of the present invention is to provide means facilitating the stowing of said handle within the container when the handle is in a removed condition relative to the container for shipping and storage.

A further object of the present invention is to provide a paint bucket which is compact, lightweight, sturdy and relatively inexpensive to manufacture.

SUMMARY OF THE INVENTION

The present invention resides in an improved paint bucket which is particularly well-suited for use as a paint container when painting trim.

The paint bucket is comprised of a container and a relatively rigid handle. The container includes a bottom portion and a side portion, the side portion defining an open top. The relatively rigid handle includes a connecting section and a gripping section. The connecting section is connected to the side of the container so as to be affixed thereto in a relatively rigid fashion, and so that the gripping section of the handle is rigidly disposed above the container. Accordingly, the handle is in condition to be grasped with relative ease and the container portion is prevented from swinging relative to the handle when the bucket is being carried.

The bucket includes means associated with the handle for defining a rest for a paint brush oriented bristle-end-down within the container. The rest-defining means includes means for nestingly accepting the handle of the paint brush when the paint brush is oriented within the container as aforesaid so as to effectively maintain the handle in an upright stationary position relative to the container.

In a particular embodiment of the invention the bucket includes guide means on the container and adapted to receive the handle connecting section therebetween. The guide means facilitates the adjustment of the handle as it is moved along a path between selected locations thereon in an orientation substantially parallel to the axis of the container.

In a further embodiment of the invention, the handle includes means for pivotally connecting the handle gripping section and the handle connecting section together. The connecting means further includes releasable locking means which facilitate locking the sections at selected relative angular positions. In a first position, the sections define a relatively large angle therebetween when the handle is connected to the container. In a second position, the sections are moved to each other defining a relatively small angle therebetween to facilitate stowing the handle within the container when the handle is in a removed condition relative to the container for shipping and storage.

BRIEF DESCRIPTION OF THE DRAWING FIGURES

Figure 5A:
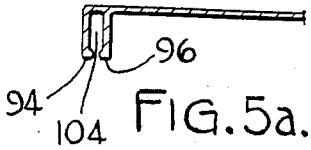
FIG. 5 is a fragmentary plan view of a top for closing the container of the FIG. 4 bucket.
Figure 5:
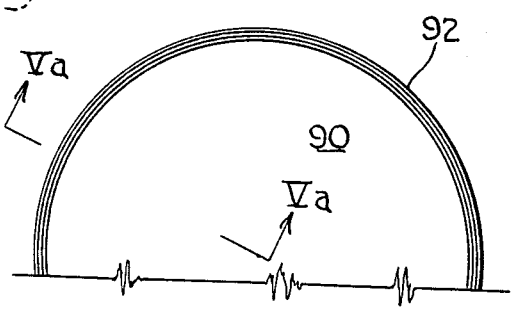

FIG. 5*a* is a cross-sectional view taken about on lines 5*a*—5*a* of FIG. 5.

Figure 2:
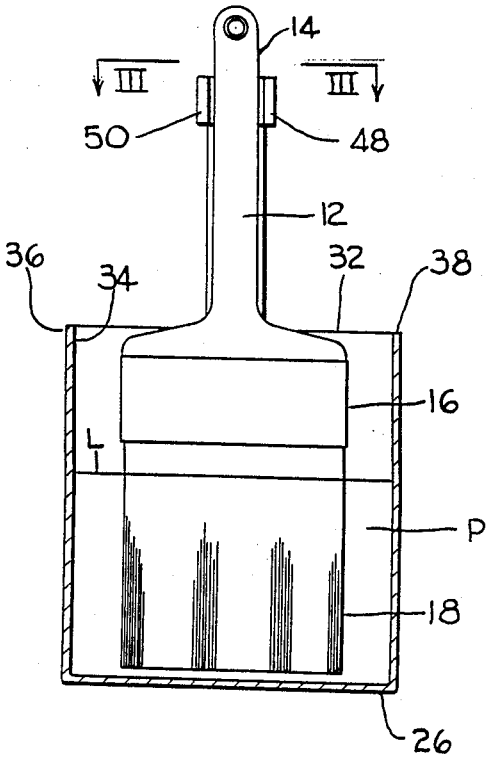
FIG. 2 is a cross-sectional view taken about on lines 2—2 of FIG. 1.
Figure 6:
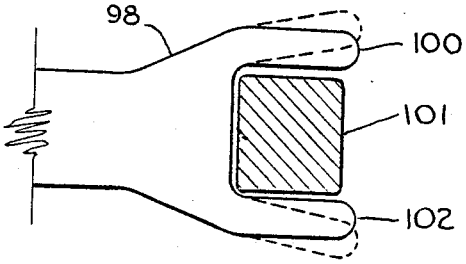

FIG. 6 is a cross-sectional view similar to that of FIG. 2 illustrating a brush rest of another embodiment of a bucket in accordance with the invention.

Figure 7:
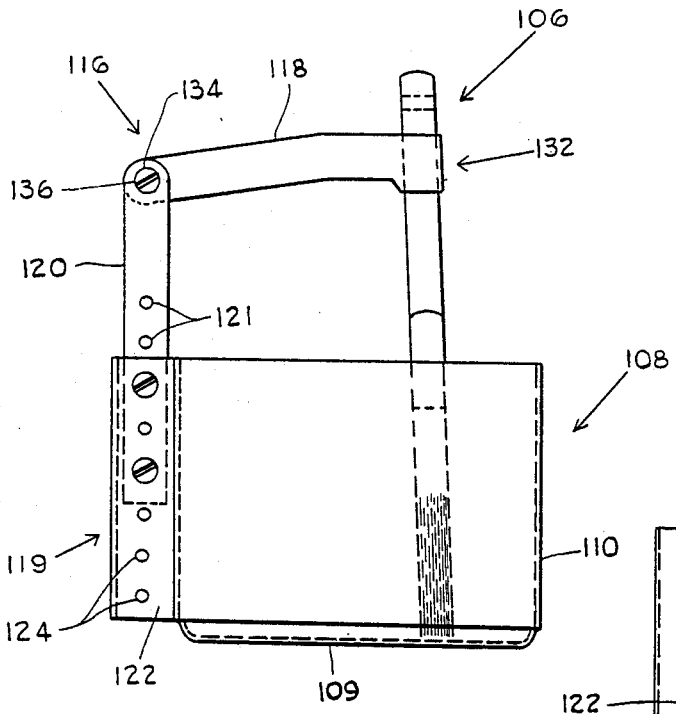

FIG. 7 is a side elevational view of a further alternative embodiment of a bucket in accordance with the invention.

Figure 8:
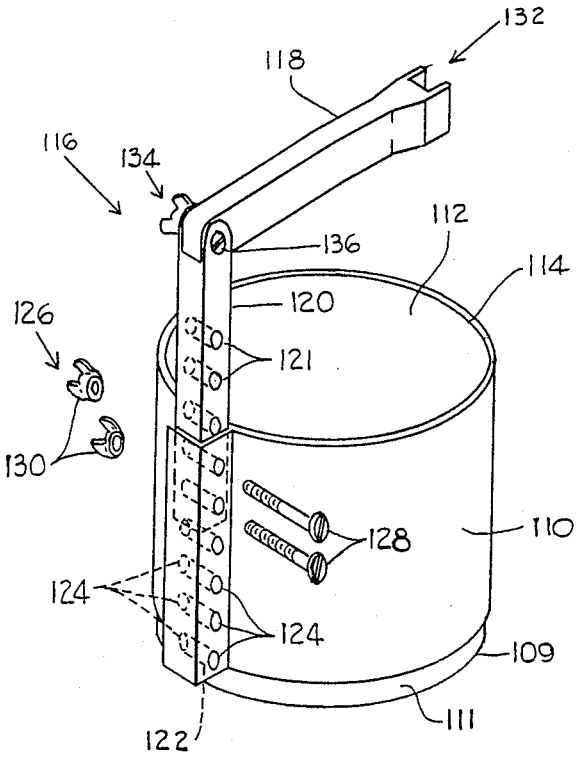

FIG. 8 is a perspective view of the bucket of FIG. 7.

Figure 9:
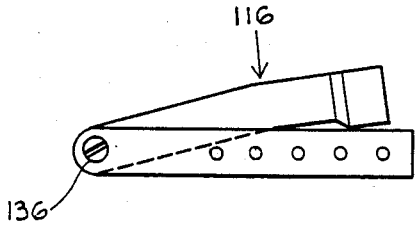

FIG. 9 is a side elevational view of the handle assembly as it appears when removed from the bucket.

Figure 10:
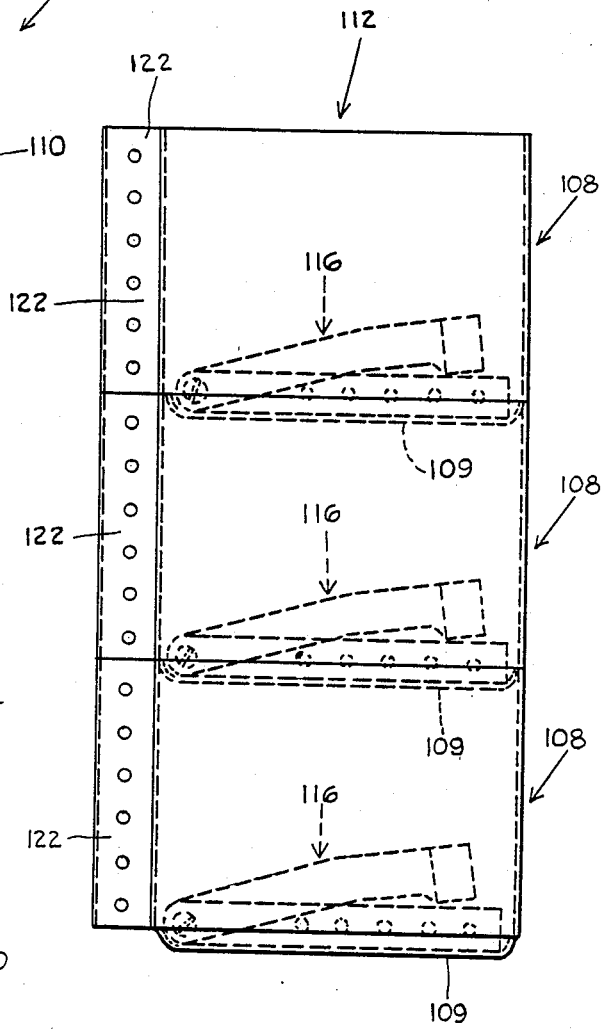

FIG. 10 is a side elevational view of the bucket of FIGS. 7 and 8 in a stacked condition showing the handle stowed therein for shipping storage.

DETAILED DESCRIPTION OF THE DRAWING FIGURES

Figure 1:
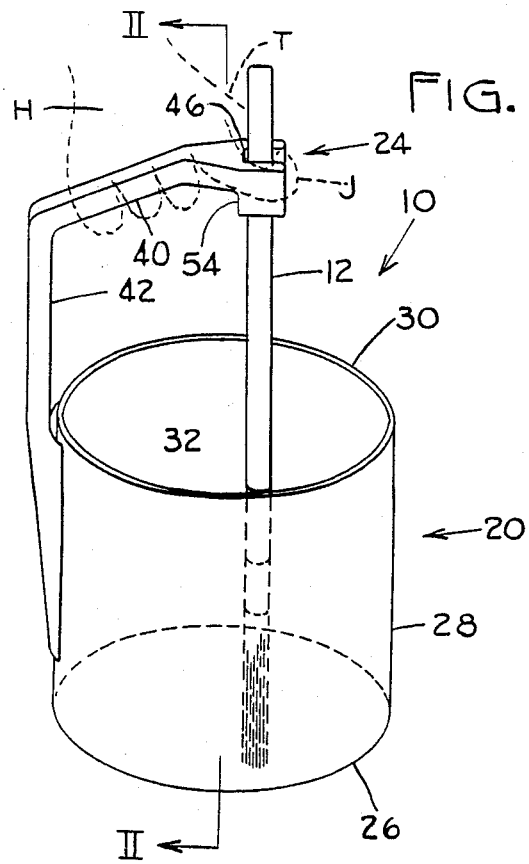
FIG. 1 is a perspective view of an embodiment of the paint bucket in accordance with the present invention and a conventional paint brush operatively positioned within the bucket for transporting purposes.

Turning now to the drawings in greater detail and considering first FIGS. 1 and 2, there is shown a paint bucket, generally indicated 10 and in accordance with the present invention, and a paint brush 12 operatively positioned within the paint bucket 10 so that the brush 12 and bucket 10 can be transported together. The brush 12 is conventional and includes a handle end portion 14 and an opposite bristle end portion 16. As best viewed in FIG. 3, the handle end portion 14 is somewhat rectangular in cross section and adapted to be comfortably grasped when the brush 12 is used. The bristle end portion 16 includes a plurality of bristles 18 attached to the bristle end portion 16 so as to depend downwardly therefrom.

With reference again to FIGS. 1 and 2, the bucket 10 includes a container 20, a handle 22 attached to the container 20, and means, generally indicated 24, defining a rest for the brush 12. The container 20 includes a circular bottom 26 and cylindrical sides 28 joined to the bottom 26 and extending upwardly therefrom. The sides 28 terminate at the upper end thereof in a rim 30 defining an open top 32. As best shown in FIG. 2, the side 28 include cylindrical inner and outer walls 34 and 36, respectively between which extends a top edge 38.

In accordance with the present invention, the handle 22 of the bucket 10 is relatively rigid and affixed to the container 20 in a relatively rigid fashion so that the container 20 is prohibited from moving relative to the handle. The handle 22 includes a gripping section 40 arranged directly above the open top 32 and the gravitational center of the bucket 10 and a connecting section 42 joining the gripping section 40 to the connecting section 42. As best shown in FIG. 1, the connection section 42 is attached at its lower end to the outer wall 36 of the container and extends generally upwardly therefrom, and the gripping section 40 extends from the upper end of the connecting section 42 in a direction slightly inclined upwardly in relation to the horizontal. The gripping section 40 is of such cross-sectional shape so as to be comfortably grasped with the hand for purposes of carrying the bucket 10 and, because the gripping section 40 is disposed above the gravitational center of the bucket, the gripping section 40 renders the bucket 10 relatively easy to hold while carrying.

Figure 3:
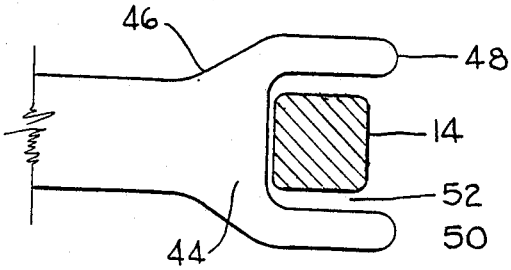
FIG. 3 is a cross-sectional view taken about on lines 3—3 of FIG. 2.

In the embodiment of the bucket 10 illustrated in FIGS. 1–3, the handle 22 and container 20 are each constructed of a relatively rigid material such as a hard plastic and are joined together as a single rigid unit. The handle 22 can be suitably affixed to the sides 28 of the container with glue or fasteners or, as is the case when the bucket 10 is constructed of plastic, the handle 22 and container 20 can be integrally molded together. The inner surfaces of the container portion 20 are relatively smooth to facilitate the cleaning thereof.

With reference again to FIGS. 1–3, the rest-defining means 24 of the bucket 10 includes means, generally indicated 44, for nestingly accepting the handle end portion 14 of the brush 12 when the brush 12 is positioned bristle-end-down within the container 20. To this end, the gripping section 40 of the bucket handle 22 defines a free end 46 opposite the connecting section-end of the gripping section 40, and the free end 46 defines a pair of spaced finger members 48, 50 extending generally axially from the gripping section. As best shown in FIG. 3, the finger members 48, 50 define an indentation 52 therebetween having an arcuate or C-like shape which opens generally toward the side of the container 20. The spacing defined between the finger members 48, 50 is of such size to accept the brush handle end 14 positioned therein. It follows from the foregoing that the rest-defining means 24 of the bucket 10 is integrally associated with the bucket handle 22.

When the brush 12 is positioned bristle-end-down within the container 20 and the brush handle end 14 is nestingly accepted by the rest-defining means 24 in the manner illustrated in FIGS. 1–3, the brush 12 is prevented from tipping from the rest-defining means 24 toward the container side 28 in every direction except through the opening provided between the finger members 48, 50. Therefore, the rest-defining means 24 effectively maintains the brush 12 in an upright orientation within the container 20 and provides a rest for the brush handle end 14 when the brush 12 is not in use. When the container portion 20 is filled with paint p to the level indicated L in FIG. 2, the bristles 18 of the brush 12, are positioned within the paint P so as to prevent the bristles from drying out.

The rest-defining means 24 provides a further advantage in that it facilitates the carrying of the bucket 10 and brush 12 together while the brush 12 is oriented upright within the container 20. More specifically the rest-defining means 24 is so arranged in relation to the portion of the gripping section 40 and adapted to be grasped by a hand when carrying the bucket 10, that the index finger of the bucket-carrying hand can be looped around the opening defined between the finger members 48, 50 so as to effectively capture and hold the brush handle end 14 between the finger members 48, 50. For example and with reference again to FIG. 1, there is illustrated in phantom hand H shown operatively grasping the gripping section 40 of the bucket handle 22 for lifting or transporting the bucket 10 wherein the thumb, indicated T, is positioned nearer the free end 46 of the gripping section 40 then the connecting section 42. With the handle grasped in the illustrated manner, the index finger, indicated J, is in condition to be looped comfortably around the finger members 48, 50 and prevent the brush handle 22 from falling or tipping out of the opening defined between the finger members 48, 50. Therefore, the bucket 10 can be lifted and carried with one hand H while the finger J of the hand H is used to maintain the brush 12 within the rest-defining means 24 and in an upright position of non-use.

With reference still to FIG. 1, the finger members 48, 50 define a shoulder 54 which depends downwardly from the remainder of the gripping section 40 and which is generally directed toward the connecting section 42. Such a shoulder 54 is advantageous in that when the handle 22 is looped over the rung of a ladder (not shown) in a manner suspending the container 20 from the rung, the shoulder 54 provides a stop for preventing the handle 22 from slipping off the rung. The shoulder 54 is laterally offset from the longitudinal gravitational center of container portion 20 so to suspend the paint bucket in a level orientation.

Figure 4:
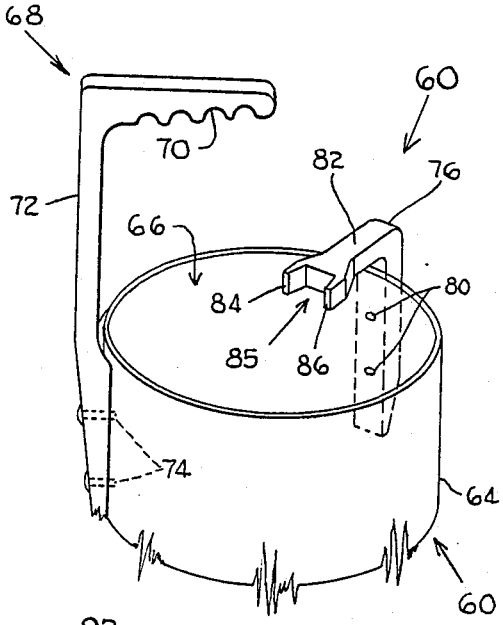
FIG. 4 is a fragmentary perspective view of an alternative embodiment of a paint bucket in accordance with the present invention.

With reference to FIG. 4 there is illustrated an alternative embodiment, indicated 60, of a bucket in accordance with the present invention. The bucket 60 includes a container 62 having a bottom (not shown) and a side 64 extending upwardly from the bottom so as to define an open top 66 bordered by a rim portion edge 67. A rigid handle 68 having a gripping section 70 and a connection section 72 is joined to the side of the container 62 in a manner rigidly arranging the gripping section 70 above the open top 66. To this end, the connecting section 72 is arranged generally vertically along side the container 62 and is rigidly affixed by means of brackets 74 to the side 64, and the gripping section 70 is rigidly joined atop the connecting section 72 so as to extend generally horizontally therefrom and so as to span at least a portion of the open top 66. The rigid connection between the handle 68 and container 62 conveniently maintains the gripping section 70 above the container 62 for purposes of grasping and prevents the container 62 from moving or swinging relative to the handle 68 while the bucket 60 is being carried by the handle 68. Because the container 62 is prevented from swinging relative to the handle 68 while the bucket 60 is being carried, the likelihood that paint will be spilled from the container 62 while being carried is substantially reduced.

The bucket 60 further includes means, generally indicated 76, defining a rest for a brush oriented bristle-end-down within the container 62. The rest-defining means 76 includes an upwardly extending vertical arm 78 rigidly fastened to the side 64 of the container 62 with fasteners 80 and a horizontally-extending arm 82 which extends generally over the horizontally-extending arm 82 which extends generally over the open top 66 and terminates in spaced finger member 84, 86 which define therebetween a region 85 dimensioned to nestingly accept the shank of a brush handle similar in construction to that of brush 12 of FIGS. 1–3. When operatively positioned within the rest-defining means 76, the brush is oriented in an upright, substantially vertical condition with the bristle end of the brush positioned within the container 62.

With reference to FIGS. 5 and 5*a*, the bucket 60 further includes a circular lid 90 for sealingly closing the open top 66. The lid 90 is generally planar in shape and defines a border section 92 which cooperates with the edge 67 of the open top 66 to seal the lid 90 to the container portion sides 64. More specifically and with reference to FIG. 5*a*, the border section 92 includes a pair of downwardly-projecting flanges 94, 96 defining a channel or groove 104 therebetween adapted to snugly and thereby sealingly accept the edge 67 of the open top 66 when the lid 90 is operatively positioned upon the container 62. To this end, the flanges 94, 96 possess a degree of flexibility and resiliency and are spaced sufficiently so as to require that the flanges 94, 96 flex slightly apart when receiving the edge 67. Both the lid 90 and container 62 of the bucket 60 are constructed of a suitable material such as plastic.

With reference to FIGS. 7 and 8 there is illustrated a further embodiment, generally indicated 106, of a bucket in accordance with the present invention. The bucket includes a container 108 having a bottom 109, a side 110 extending upwardly so as to define an open top 112 bordered by a rim portion 114. A substantially rigid handle, generally indicated 116 having a gripping section 118 and a connecting section 120, is attached to the side 110 of container 108 such that the connecting section adjusts along a path generally parallel to the container and the gripping section 118 is disposed above the open top 112. The connecting section 120 further includes a series of circular bores or apertures 121 at selected locations there along which extend laterally therethrough, each to form an opening through the connecting section. Attached to the side of the container 110 is a guide means, generally indicated 119, in the form of a relatively rectangular channel 122 extending along side 110 of container 108 and substantially parallel to the longitudinal axis of container 108. The channel 122 is adapted to receive the connecting section 120 of handle 116 therein for guiding the handle along a path substantially parallel to the longitudinal axis of container 108 and for connecting handle 116 to container 108 at selected locations along that path. The guide means 119 is either formed integrally with the container side 110 or attached thereto by conventional means such as screws (not shown). The channel 122 has a plurality of paired openings 124, 124 on each side thereof in a face-to-face relation at predetermined distances there along. When the handle 116 is moved within and along channel 122 the paired openings 124 of channel 122 align with various ones of the apertures 121 of connecting section 120 at selected handle locations.

Retaining means, generally indicated 126, secure the connecting section 120 of handle 116 to the channel 122 of guide means 119 in a relatively rigid stationary position relative to the container such that the gripping section 118 is disposed above the open top 112 of container 108. It is understood that any such retention means such as a snap or spring mechanism can be employed without departing from the scope of this invention. For purposes of illustration only, and not limitation, FIG. 8 shows a retention means 126 comprising a wing nut assembly having a shaft portion 128 and a nut portion 130. The handle 116 is moved within the channel along the aforementioned path to the desired height whereat paired openings 124 of channel 120 align with an aperture 121 of handle connecting section 120 so that the shaft 128 of retaining means 126 can be inserted through the paired openings and aperture. The nut 130 is then tightened upon shaft 128 so that the nut rests securely against the outer side edge 132 of channel 122 thereby securing the handle in a stationary position relative to the container 108. When the nut is removed and shaft 128 is retracted from between the openings 124 and aperture 121 the handel 116 is free to be moved along the path to facilitate adjustment of the handle to a different position or removal thereof from the channel. The adjustment feature of the handle facilitates the use of various length brushes by allowing the user to readily adjust the brush rest means, generally indicated 132, between various heights.

With reference to FIGS. 8–10, the handle 116 includes means, generally indicated 134, for pivotally connecting the handle gripping section 118 and handle connecting section 120 together. It is understood that any known arrangement in the art whereby the gripping section 118 is pivotally attached to the connecting section 120 is within the scope of the present invention. For example, one section could be provided with spaced-apart parallel tabs or the like extending from opposite sides thereof and provided with aligned openings to register with a bore provided in the end of the other section so that a pivot pin can extend through the openings and the bore. Means 134 further includes a releasably locking means 136, best shown in FIG. 8, whereby the sections are securely locked at selected relative angular positions so that in a first position the sections define a relatively large angle A as shown in FIG. 8 which facilitates the use of the handle, and in a second position a relatively small angle B as shown in FIG. 9 when the handle is in a removed condition relative to container 108. Means 136 is shown herein as a conventional wing nut for connection on a threaded end of the exemplary pivot pin for purposes of illustration only and is not limited thereto.

With reference to FIG. 10, the handle 116 is in a removed condition relative to the container and defines the relatively small angle B, as shown in FIG. 9, such that the overall length of the handle assembly is less than the inside diameter of container 108 which thereby facilitates the stowing of the handle within the container during shipping and storage of the bucket. Also, the bottom 109 has a reduced outer diameter 111 which facilitates the stacking of the bottom 109 of one bucket within the open top 112 of another bucket as shown in FIG. 10. Alternatively, side 110 could have an appropriate draft angle (not shown) which would also facilitate the stacking of the bottom 109 of a bucket within the open top 112 of another bucket.

It will be understood that numerous substitutions can be made to the afore described embodiments without departing from the spirit of the invention. For example, although the rest-defining means 24 of the bucket 10 of FIGS. 1–3 has been shown and described as being of such size to loosely receive the shank of a brush handle 14 operatively positioned therein, a rest in accordance with the present invention can snugly accept and thereby securely retain the brush handle operatively positioned therein. For example, there is illustrated in FIG. 6 a rest-defining means, generally indicated 98, including spaced, projecting finger means 100, 102 between which is defined a spacing 101 adapted to snugly accept a brush handle placed therein. Furthermore, the free ends of the finger members 100, 102 are directed toward one another and the finger members 100, 102 possess a degree of resiliency and flexibility so that a brush handle forced between the finger members 100, 102 is held therebetween in a snap-fit relationship. The finger members 100, 102 can be constructed of a suitable material such as plastic for permitting the free ends of the finger members 101, 102 to flex slightly apart when the brush handle is forced therebetween. Such a rest-defining means 24 thereby clamps the brush in an upright position of non-use. Accordingly, the afore described embodiments are intended for purposes of illustration and not as limitation.

What is claimed is:

1. A paint bucket for use in painting trim or the like comprising:

a cylindrical container having a bottom, a cylindrical side wall and an open top, the side wall having a height less than the diameter of the container;

handle and brush rest means connected to the side wall of the container, the handle and brush rest means including a generally vertically extending connecting section having an upper end portion and a lower end portion, the lower end portion being rigidly interconnected to the container, a generally horizontally extending gripping section interconnected at one end thereof to the upper end portion of the connecting section, the gripping section having a portion extending over the center of gravity of the container for gripping with a hand to transport the container, and a pair of spaced finger members interconnected to the other end of the the gripping section and adapted to nestingly accept a handle of a paint brush therebetween when the brush is oriented bristle-end down within the container;

the handle and brush rest means being connected to the side wall of the container so that when a working amount of paint is placed within the container and the handle of a paint brush is operatively placed between the spaced finger members only the bristle-end of the brush will extend into the paint within the container thereby preventing the bristles from drying out while eliminating excess paint from getting onto the paint brush.

2. The paint bucket of claim 1, wherein the handle and brush rest means further including a generally downwardly directed projection means for facilitating hooking the handle and brush rest means over the rung of a ladder so that the container hangs from the rung of the ladder in a substantially horizontal plane of orientation.

3. The paint bucket of claim 1, wherein the bucket further comprises:

guide means connected to the side wall of the container for receiving the lower end portion of the connecting section therebetween for facilitating the adjustment of the connecting section in a vertical orientation relative to the container as it is moved between preselected locations; and retaining means associated with the guide means for securing the connecting section to the guide means at the preselected locations.

4. The paint bucket of claim 3, wherein at least one of the guide means and the connecting section include a plurality of corresponding vertically spaced openings adapted to receive the retaining means therebetween such that the connecting section is secured in a stationary position at one of the preselected locations.

5. The paint bucket of claim 1, wherein the side walls of the container further include a rim portion for cooperation with a lid for sealingly closing the open top.

6. The paint bucket of claim 1, wherein the bucket is constructed of a relatively rigid plastic material.

* * * * *